United States Patent [19]

Shiomi et al.

[11] Patent Number: 4,703,317

[45] Date of Patent: Oct. 27, 1987

[54] BLINKING OF A SPECIFIC GRAPH IN A GRAPHIC DISPLAY

[75] Inventors: Masuo Shiomi; Takashi Aramaki, both of Nara, Japan

[73] Assignee: Sharp Kabushiki Kaisha, Osaka, Japan

[21] Appl. No.: 563,509

[22] Filed: Dec. 20, 1983

[30] Foreign Application Priority Data

May 9, 1983 [JP] Japan ..... 58-82285

[51] Int. Cl.[4] ..... G09G 1/16

[52] U.S. Cl. ..... 340/723; 340/703; 340/747; 340/750

[58] Field of Search ..... 340/709, 723, 725, 747, 340/701, 703, 750

[56] References Cited

U.S. PATENT DOCUMENTS

| | | | |
|---|---|---|---|
| 4,201,983 | 5/1980 | Magerl et al. | 340/709 |
| 4,439,760 | 3/1984 | Fleming | 340/747 |
| 4,451,825 | 5/1984 | Hall et al. | 340/735 |
| 4,495,491 | 1/1985 | Postl | 340/709 |
| 4,509,043 | 4/1985 | Mossaides | 340/729 |

*Primary Examiner*—Marshall M. Curtis

*Attorney, Agent, or Firm*—Birch, Stewart, Kolasch & Birch

[57] ABSTRACT

A graphic display is characterized in that; it provides display memory corresponding to display picture covering a plurality of pictures, and causes a plurality of display memory units to properly distribute a variety of graphic patterns to be displayed on the screen for storage, while the graphic display unit also provides a table memory that holds data indicating either the presence or absence of blinking to be applied to the graphic patterns, and then simultaneously reads display memory containing plural pictures synchronously with the display scan and draws out the blink data from table memory by using each bit of plural pictures as the logic condition, thus causing a specific graph pattern to blink according to the blink data of the table memory, and as a result, blinking can be easily performed at a speed faster than any of the conventional graphic display units.

1 Claim, 4 Drawing Figures

BLINKING OF A SPECIFIC GRAPH IN A GRAPHIC DISPLAY

BACKGROUND OF THE INVENTION

The present invention relates to a graphic display device, more particularly, to a graphic printer system that can process graphs by using simple and high-speed blinking means.

Conventionally, any of the existing graphic display devices provides a display memory that deals with individual dots on the CRT display screen on a 1:1 basis, while the display device reads the graphic pattern of the display memory synchronously with the raster scan and sends the pattern to the display driver circuit so that a specific graph can be output onto the CRT display screen. When writing a graphic pattern into the display memory, a specific graphic data is drawn out of data memory storing graphic data under the CPU control, which is then sent to the graphic display controller (GDC), in which, said data is developed into a graphic dot pattern before said pattern is stored in the display memory. The conventional practice is to cause the graphic pattern on the CRT display screen to perform blinking so that the operator will pay attention to it. Generally, when causing a graphic pattern to blink, such an existing device must perform a complex process for causing the pattern to be stored in said display memory before blinking, i.e., it has to rewrite dots corresponding to the designated patterns into "1" and "0" in every blinking cycle.

OBJECT AND SUMMARY OF THE INVENTION

The present invention primarily aims at providing a graphic display that can easily perform a blinking process at a very fast speed by eliminating any complex data processing. Another object of the present invention is to provide a display that characteristically contains a table storing data indicating either the presence or absence of blinking of a graphic pattern reproduced in accordance with the dot data sent from the display memory that contains a plurality of pictures and also forms a plurality of display memory devices. A preferred embodiment of the present invention provides a plurality of display memory devices covering plural rounds of display pictures and causes the plural display memory devices to contain a variety of graphic patterns that are to be shown on the screen for storage in these devices after being split into individual units, while the preferred embodiment of the present invention also provides table memory that contains data indicating either the presence or absence of the blinking which is applicable to graphic patterns to be shown on the CRT display screen. In the preferred embodiment, display memory devices cover plural rounds of display pictures that are to be simultaneously read out synchronously with the display scan. The preferred embodiment further draws out the blink data from the table memory by using each bit of the plural pictures as the logic condition so that a specific graphic pattern will blink according to the blink data from the table memory. This causes the entire display system to easily perform blinking at a speed faster than any of the conventional devices.

DETAILED DESCRIPTION OF THE INVENTION

Figure 1:
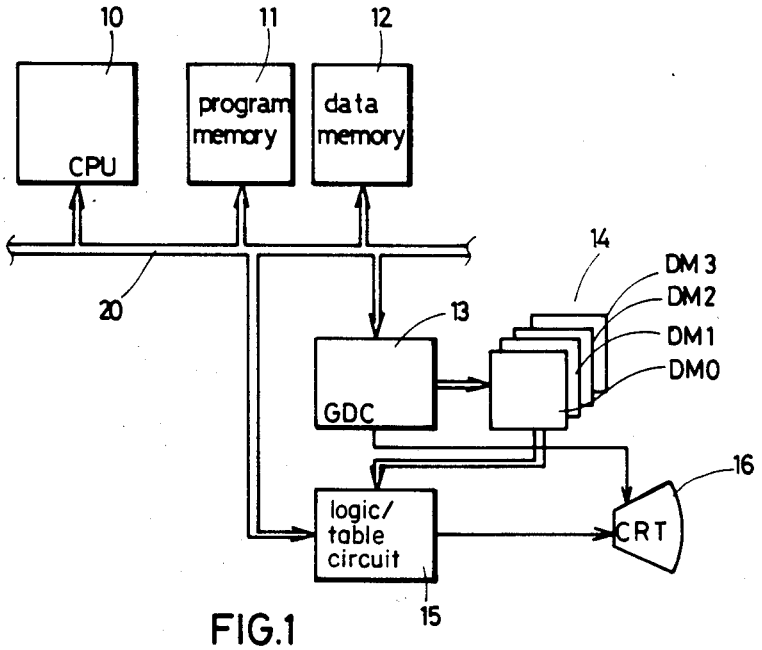
FIG. 1 is a simplified block diagram of a graphic display device as a preferred embodiment of the present invention.

FIG. 1 is a simplified block diagram of a graphic data processing device, in which, reference number 10 denotes a CPU that is connected to data bus 20. The CPU 10 is subject to the control of programs of a program memory 11 that stores the program memory. Reference number 12 is a data memory also connected to the data bus 20, while a variety of buffers and flags, subject to the control of the CPU 10, are present in the data memory. The data bus 20 is connected to the graphic display control unit 13 (GDC) and the logic/table circuit 15 for causing the graphic patterns to blink. The GDC 13 is composed, for example, of mPD220 (Nippon Electric Company) being well known in the industry, and it causes graphic data from the CPU 10 via data bus 20 to be developed into designated graphic dot patterns before these patterns are stored in the display memory 14. The display memory 14 comprises 4 units of memory, i.e., DM0, DM1, DM2, and DM3, each correponds to pictures to be shown, while each of these memory units stores dot patterns independently, i.e., based on a specific control of the CPU 10, each can be simultaneously accessed by the GDC 13 synchronously with the raster scan of the CRT 16, enabling the GDC 13 to read the need dot data from memory units.

Figure 2:
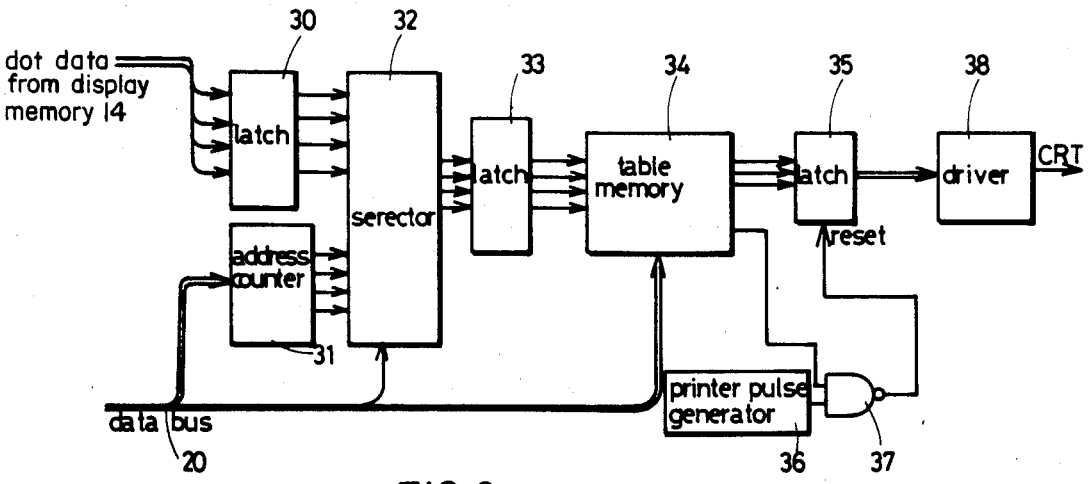
FIG. 2 is a detailed block diagram showing the essential part of the device of FIG. 1.

Basically, the logic table circuit 15 is of a structure as shown in FIG. 2 the logic table circuit memorizes a variety of data related to colors and graphic blinking that are input via data bus 20 under the CPU control to the table according to various logic conditions. It also selects the designated table according to the dot data logic read out of four pictures of the display memory 14 synchronously with the raster scan of the CRT 16, and so it identifies whether colors and the blinking are present, or not.

CRT 16 comprises, for example, a 14 inch screen containing 768×550 dots, which are subject to a raster scan performed by horizontal (H-sync) and vertical (V-sync) synchronizing signals fed from the GDC 13.

Although not shown in the drawings, a keyboard unit and a variety of terminal units are connected to the data bus 20 via interface units. A concrete example of the logic/table circuit 15 shown in FIG. 2 is described below. Reference number 34 is a table memory, which can be accessed by address data from latch circuit 33. Color data based on the three primary colors and the blink data are memorized in one location that is accessed by the address data. In a preferred embodiment, a total of 16 locations are provided by four address bits, thus making it possible to display 16 colors and also specify either the presence or absence of the blinking according to the 16 graphic patterns.

Figure 3:
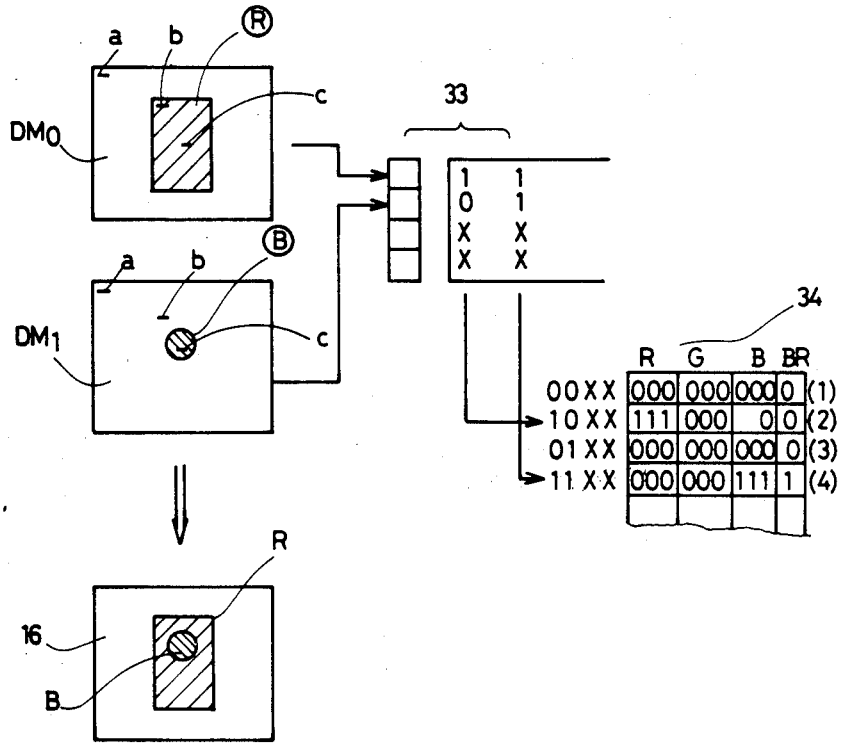
FIGS. 3 and 4 respectively show the configurations peripheral to the table memory, showing the blink control operation.

Data in each location is provided with addresses by said latch circuit 33, while each data is memorized in memory via data bus 20 under the control of the CPU 10. Dot data DMO through DM3 is fed from the display memory to said latch circuit 33 via an other latch circuit 30 and a selector 32. In other words, 4-bit dot data simultaneously read out of DM0 through DM3 of the display memory 14 shown in FIG. 1 is sent to the latch circuit 30 via selector 32. Reference number 35 is a latch circuit, 36 is the blink pulse generator, 37 denotes a gate and 38 is the display driver circuit. Next, the blink process operation is described below. The description relates to the case in which, as shown in FIG. 3, a square graphic pattern is displayed in red (R) on the CRT 16 and a blue (B) circle being displayed in said square pattern and the blue circle is subject to blinking. In this case, under the control of the CPU 10, of the four units DM0 through DM3 of the display memory 14, DM0 will memorize a square graphic pattern and DM1 will memorize a circular graphic pattern. In the present description, only the cases of DM0 and DM1 are cited for convenience.

During the display operation, synchronously with the raster scan, GDC 13 simultaneously reads the data of DM0 through DM3 of said display memory 14. Data read out of DMO through DM3 are combined, that is, a 4-bit piece of data is created with one bit corresponding to display data at each of the memory units, before being sent to the driver circuit 38 of the CRT 16. 4-bit data from DM0 through DM3 is sent to the latch circuit 33. When the raster scan pulse is at the position of display memory 14 (DM0 to DM3) corresponding to the point denoted by "a" in FIG. 3, data "00XX" is fed to the latch circuit 33, and as a result, by using this data as an address, a location of the table memory 34 is selected. Each location of said table memory 34 contains data denoting the tonal range of red (R), green (G), and blue (B) each composed of 3-bits and a bit denoting either the presence or absence of the blinking (BR). Therefore, when the CRT performs a raster scan against said position "a", since neither DM0 nor DM1 contains any graphic pattern at that position, the first location of the table memory 34 is selected. In this case, although the data of the first location of the data memory 34 is sent out, substantially, no control is effected. When the raster scan pulse is at the position "b", a graphic pattern exists in DM0 of data memory 14, Cand so a data "10XX" is fed to the latch circuit 33. This data selects the second location of the table memory 34 and causes the red (R) tonal data to go out so that a red dot will be displayed. During this period, since the blink bit remains "0", no blinking operation is performed. When the raster scan pulse is at the position "c", since graphic patterns are present in DM0 and DM1 of the data memory 14, data "11XX" is fed to the latch circuit 33. This data selects the 4th location of the table memory 34, causing the blue (B) tonal data to go out and simultaneously activates gate 37 by using blink bit "1".

As a result, gate 37 opens while the binary bit "1" is being output from the blink pulse generator 36, thus resetting the latch circuit 35. When said generator 36 outputs "0", data from the latch circuit 35 is sent to the driver circuit 38, thus dots can be displayed in any desired colors. In this way, when the blink bit is "1", latch circuit 35 can be either set or reset according to the cyle of the blink pulse, thus permitting dots to blink. As a result, a red square picture pattern and a blue circular pattern in the red square pattern are displayed in the display screen of CRT 16 in blinking. Another embodiment of the present invention is described below.

Figure 4:
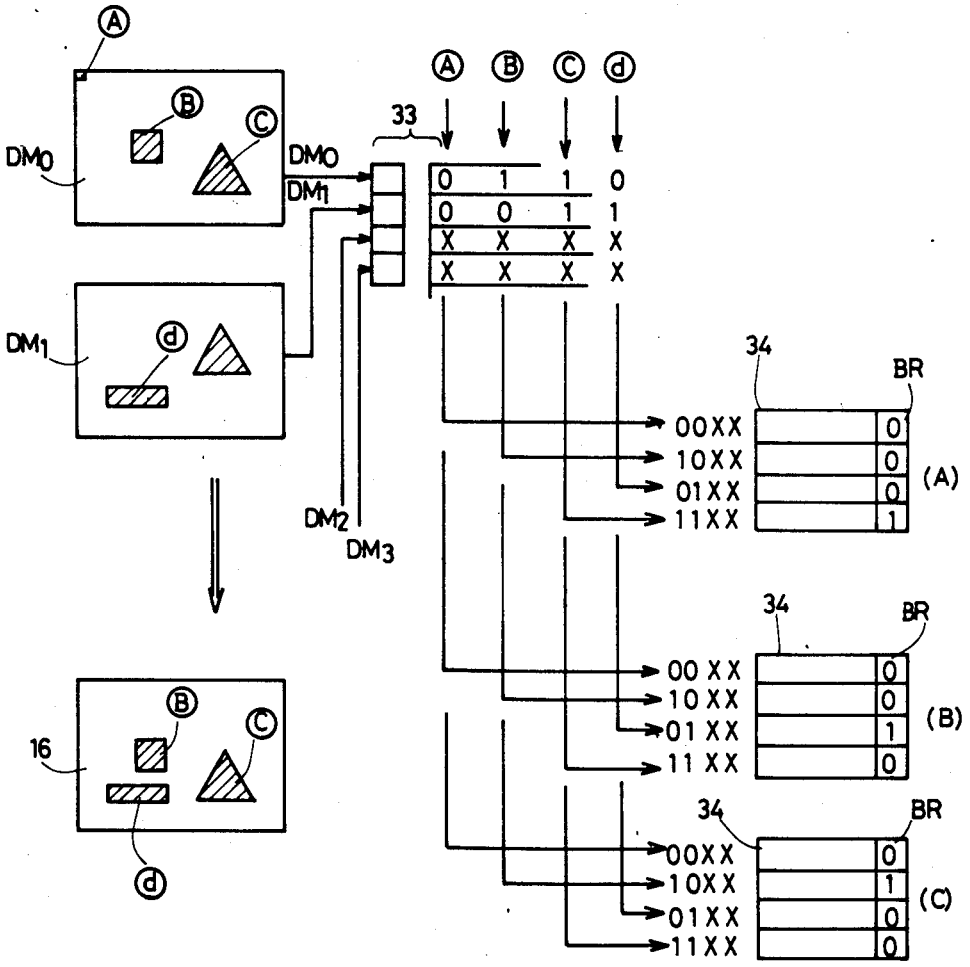

The relationship between the graphic pattern memory into DM0 through DM3 of the display memory and the table memory may be composed as shown in FIG. 4 as the logic condition. Composition of the table memory 34 of FIG. 4 (A) denotes such a case in which only the triangle pattern blinks. Composition of the table memory 34 of FIG. 4 (B) denotes such a case in which only the rectangular pattern blinks. Composition of the table memory 34 of FIG. 4 (C) denotes such a case in which only the square pattern blinks.

What is claimed is:

1. A device for blinking a specific graph in a graphic display produced with a raster scan of a cathode ray tube, comprising:

memory means for storing a plurality of dot display patterns, said memory means including a plurality of memory units with each one of said plurality of dot display patterns being stored in a corresponding one of said plurality of memory units;

graphic display controller means, connected to said memory means, for reading display signals corresponding to said plurality of dot display patterns into and out of said memory means;

logic table circuit means, connected to said memory means, for developing a picture signal and a blinking display signal from said display signals read out of said memory means by said graphic display controller, said logic table circuit means including, data address means, responsive to said display signals read out of said memory means, for developing an address signal synchronous with the raster scan of the CRT, said address signal being a compilation of at least one bit from selected ones of said plurality of dot display patterns in selected ones of said memory units said at least one bit corresponding to display data at a position corresponding to a position scanned in the raster scan of the CRT, table memory means for storing, at addresses that correspond to said address signals, display signal characteristic data, said display signal characteristic data including a plurality of color indicating data and a plurality of blinking characteristic data of respective compilations of at least one bit of selected ones of said dot display patterns, controller means, responsive to said data address means, for accessing said table memory means to produce an output control signal, and blinking means, responsive to said output control signal for producing said blinking display signal in accordance with said plurality of blinking characteristic data; and driver means responsive to said picture signal and said blinking display signal, for driving the CRT to produce a graphic display on the CRT and enable designated positions of said graphic display to blink in accordance with said blinking display signal.

* * * * *